United States Patent [19]

Bonasso

[11] Patent Number: 4,464,803

[45] Date of Patent: Aug. 14, 1984

[54] TENSION ARCH STRUCTURE

[76] Inventor: Samuel G. Bonasso, 241 S. High St., Morgantown, W. Va. 26505

[21] Appl. No.: 372,805

[22] Filed: Apr. 28, 1982

[51] Int. Cl.[3] ..... E01D 11/00; E04B 1/32

[52] U.S. Cl. ..... 14/20; 14/9; 14/25; 52/86; 52/227

[58] Field of Search ..... 14/9, 10, 17, 18, 73, 14/14, 21, 6, 20, 19, 24–26; 52/227, 226, 223 R, 87, 86, 228, 229, 80, 83

[56] References Cited

U.S. PATENT DOCUMENTS

| | | | |
|---|---|---|---|
| Re. 29,249 | 6/1977 | Rice | 52/227 |
| 634,026 | 10/1899 | Pittman | 14/6 |
| 1,388,584 | 8/1921 | Marsh | 52/87 |
| 2,101,538 | 12/1937 | Faber | 52/227 |
| 2,842,786 | 7/1958 | Digby-Smith et al. | 14/22 X |
| 3,561,178 | 2/1971 | Finsterwalder et al. | 14/19 X |
| 3,708,944 | 1/1973 | Miyake | 52/227 X |
| 3,909,863 | 10/1975 | Macrander et al. | 14/17 |
| 4,275,537 | 6/1981 | Pinson | 52/227 X |
| 4,373,837 | 2/1983 | Lin et al. | 14/73 X |

FOREIGN PATENT DOCUMENTS

| | | | |
|---|---|---|---|
| 817468 | 8/1951 | Fed. Rep. of Germany | 14/18 |
| 1126903 | 4/1962 | Fed. Rep. of Germany | 14/20 |
| 2152030 | 3/1978 | Fed. Rep. of Germany | 14/9 |
| 664493 | 7/1964 | Italy | 14/9 |
| 159742 | 3/1979 | Netherlands | 14/9 |
| 137479 | 10/1952 | Sweden | 52/226 |
| 495474 | 11/1938 | United Kingdom | 52/226 |
| 1348710 | 3/1974 | United Kingdom | 14/21 |
| 727737 | 4/1980 | U.S.S.R. | 14/10 |
| 804752 | 2/1981 | U.S.S.R. | 14/18 |

*Primary Examiner*—Ernest R. Purser
*Assistant Examiner*—Beverly E. Hjorth
*Attorney, Agent, or Firm*—Roberts & Floyd

[57] ABSTRACT

A structural system for use in bridges, buildings and other structures. The system supports part of its load by tension action and part of its load by arch action. Cables are stretched and anchored between end supports. Lateral compressive elements are placed over the cables and fit over grooves across the bottoms of the elements. The grooves vary in depth. The cables are near the bottom of the elements at the center span and near the top of the elements at the end supports.

7 Claims, 26 Drawing Figures

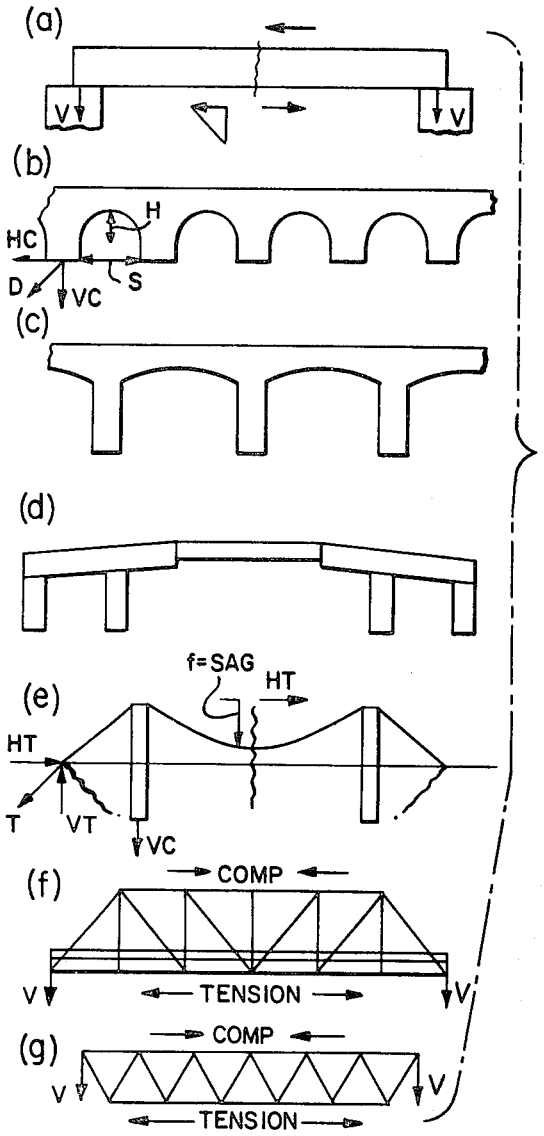
FIG. 1.
(PRIOR ART)
FIG. 2.
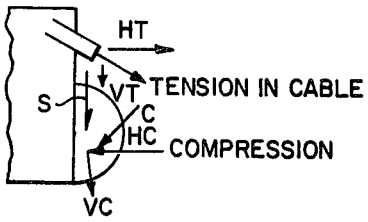
FIG. 3.
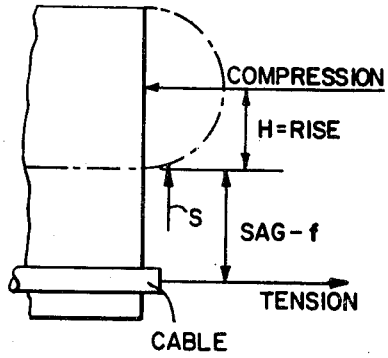
FIG. 4.
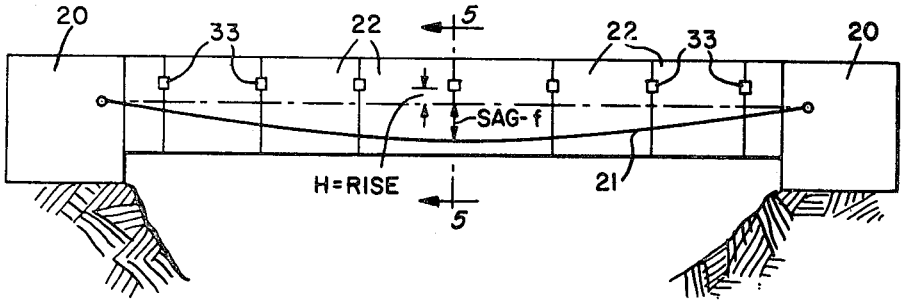

TENSION ARCH STRUCTURE

CROSS-REFERENCE TO RELATED APPLICATION

This invention is not disclosed in any co-pending application for patent or any issued patent.

BACKGROUND OF THE INVENTION

1. Field of Invention

The tension arch is a structural system useful in bridges, buildings and other structures which must support loads across a span.

2. Description of Prior Art

The bridge embodiment of the tension arch has elements of many types of prior bridges. For this reason each of the major types of bridge structures are discussed. Bridge structures are conventionally divided into one of three types, beam, arch and suspension. Two additional types, trusses and cantilevers are often called composites or combinations of these three types. All of these classifications are more or less arbitrary.

The Beam

This bridge shown in FIG. 1A is undoubtedly the oldest bridge. At its most basic it is a tree fallen across a stream. It is supported at either end, and the strength of the beam member itself supports the dead weight of the beam and the weight of the live load.

The steel I-beam bridge, is quite common today. The web or vertical panel provides the strength to resist the shear while the flanges or top and bottom panels resist the bending moment. These bridges could, however, also be called truss bridges with a solid web between the upper and lower chords.

The Arch

The Romans gave the arch bridge to western civilization. This bridge, shown in FIG. 1B, was made of stone or brick, often without mortar. The arch was semi-circular, rarely over 80 feet in diameter or span, supported by piers of about a third the span in thickness. Each arch was structurally independent of the next.

The best preserved of these bridges in Italy is the Pons Augustus in Rimini, built about 20 B.C. One of the largest is the three tier acqueduct at Pont du Gard, France. For a millenium, this design was the state of the art, as witnessed by the London Bridge, built in 1209. The soundness of the design is shown by the centuries these bridges have been in use.

In the Renaissance builders began to flatten the bridge arch, or widen the span between piers, as shown in FIG. 1C. Each span however, was free standing, being supported on its two piers. An example is the Santa Trinita Bridge in Florence, built in 1569.

For hundreds of years Gothic cathedrals had used flying butresses to transfer the horizontal thrust of an arch beyond the pier supporting the vertical load. This idea was finally adopted for bridges by Jean Rodolphe Perronet. His Pont de Neuilly bridge in France, built in 1774, had elliptical arches spanning 120 feet where each of the five arches supported part of the horizontal thrust of the adjoining arch.

Cantilever

This type of bridge, shown in FIG. 1D, was widely used in the Orient several centuries ago. In the seventeenth century the Wanchpore Bridge in Bhutan was built, with a main span of over one hundred feet. Timbers were corbelled out from each abutment and the central interval was spanned by a light beam.

In the 1860's the Germans invented the modern metal cantilever truss bridge. The Cooper River Bridge in Charleston, South Carolina, built in 1920, is an example, and has a main span of 1,050 feet. The cantilever becomes a joined arch when the two arms touch as in the viaduct at Viaur, France.

The Suspension Bridge

Rope suspension bridges antedate recorded history. In the seventh century iron chains were used as cables in the Orient. The first chain cable bridge in Europe was the Winch Bridge over the Tees in England, built in 1741. All of these bridges laid the flooring on the cables.

In 1801 an American, James Finley, suspended a level roadway from the chain cables, making the modern suspension bridge shown in FIG. 1E. In 1816 he obtained a patent on a bridge using wire cables instead of iron chains. The United States retained the lead in suspension bridges with the 1,000 foot span bridge built in 1848 at Wheeling, West Virginia, by Ellet, and the 1,600 foot span Brooklyn Bridge of John Roebling built in 1883, both of which are still in use.

This design reached a high degree of development in the 3,500 foot span of the George Washington Bridge in 1931 and the 4,200 foot span of the Golden Gate Bridge in 1937. Suspension bridge with longer spans have since been built.

The Truss

The early truss bridges were the wooden covered bridges. The Burr-arch, patented in 1817 by Theodore Burr, was used in the majority of our covered bridges. It was an arch-strengthened truss.

During the mid-nineteenth century, truss bridges were built of a composite of wood and metal members, iron rods being used initially as tension members.

By the twentieth century iron truss bridges were widely used by railroads. If the rails were on the level of the lower chord, as in the Pratt truss, it was called a through bridge, as shown in FIG. 1F. If the rails were on the upper chord, as in the Warren truss, it was called a deck bridge, as shown in FIG. 1G.

Metal arch bridges are usually classified as trusses or not depending on the appearance and composition of the cross-section of the arch. Thus the Eads Bridge at St. Louis, built in 1874, is called a trussed arch, while the Rainbow Bridge at Niagara Falls is called simply a metal arch bridge. In both cases, however, the soffit or bottom surface of the arch is under tension.

Reinforced Concrete

The first reinforced concrete bridge in the United States, built in 1884, was the Alvord Lake Bridge in San Francisco. This has become the predominate form of highway bridge world-wide in the twentieth century.

A common feature of many of these bridges is an arch, usually below the bridge. In all cases due to the span length, the arch itself must resist tension due to bending moments. The earliest European bridges such as those built in 1905 at Liege, Belgium and Canton Grisons, Switzerland, made the roadway an integral part of the arch. In most such bridges, such as the Russian Gulch Bridge in California, built in 1940, the roadway is merely supported by the arch and forms no part of the truss.

Eugene Freyssinet built a prestressed concrete bridge at Luzancy, France in 1946. Precast concrete arch segments were attached end to end by taut cables to form the rib of the arch. The rib itself was then threaded with a cable from abutment to abutment to pull the sections into compression and form an arch by additional prestressing.

Structural Forces

Every bridge or spanning structure must obey certain basic laws of natural science. They each must distribute to the earth both the weight of the bridge structure, the dead load, and the weight and impact of the live load. This is accomplished through the ability of the structure's material to absorb and transmit energy.

The beam transmits its loads through each abutment by two simple vertical compressive forces (V) as shown in FIG. 1A. As shown in FIGS. 1F and G, a truss bridge likewise transmits its loads to the earth through two simple vertical compressive forces (V). The same is true for reinforced and prestressed beam bridges.

In the simple arch of FIG. 1B the load is similarly transmitted through compressive forces. However, the forces are both horizontal (HC) and vertical (VC) or at least the single diagonal (D) force may be resolved into these two forces.

The suspension bridge, as shown in FIG. 1E, transmits its load to the earth through a variety of forces. There is the tension force in the cable (T), which can be resolved into a horizontal (HT) and vertical (VT) tensile forces. In addition there is the vertical compressive force (VC) on each tower.

The same laws of natural science affect the forces in the bridge structure at mid-span and limit the materials and designs which may be used.

Inside the beam at center of the span, as shown in FIG. 1A, there are equal and opposite compressive (C) and tensile (T) forces and shear forces which may be expressed as a combination of shear and moment forces, neglecting any axial loading. As shown in FIGS. 1(F) and (G), a truss has the same equal and opposite forces, and may therefore be viewed as an expanded beam.

Inside the arch, at the center of the span there is a net compressive force which varies over the cross-section of the arch. At very low ratios of span to height (S/H) the compressive loading becomes nearly uniform across the area at mid-span. As the ratio increases the bottom side of the arch, the soffit, is subject to tension. Since masonry and concrete have low tensile strength the pure masonry arch has a limiting low span to height ratio.

In a reinforced concrete structure, the reinforcing steel withstands the tension, thus increasing the load bearing capacity of the beam or arch. A prestressed beam adds stored energy through an internally imposed axial load allowing the beam to support greater loading before the elastic deformation of the beam causes the concrete to deform in tension and transmit its load to the steel reinforcement.

A suspension bridge is loaded, at mid span, by a pure horizontal tensile force (HT) on the cable. There is no significant load, compressive or tensile, carried by the roadway to the earth except through the cable.

SUMMARY OF INVENTION

The tension arch structure is a structural system designed to support loads over a level or inclined span or series of spans. Its uses include bridges, flooring, roofs of buildings as well as other structures.

The tension arch structure has cables strung from end support to end support. These have a predetermined sag. A series of similar compression blocks sit on top of the cables and are held in place by depending grooves surrounding the cables. The grooves each have depths to compensate for the amount of sag along the cable where the block is located.

The blocks have an upper surface defining a load bearing area. The load bearing area is at a predetermined height from end support to end support. The blocks completely fill the span from end support to end support. They support part of the live load in compression. The maximum compressive forces are at the top of the block in the center of the span and at the bottom of the block at the ends of the span.

As shown in FIG. 2, the tension arch transmits its force to the earth through a combination of forces. There is the tensile force (T) of the cable and the compressive force (C) of the block. The horizontal tensile component (HT) and horizontal compressive component (HC) forces are opposed and are not equal. Vertical tensile (VT) and vertical compressive and shear forces (S) are also present. The dead load of the bridge is supported by, and transmitted to the end supports, primarily by the tensile force (T) of the cable. The live load of the bridge is transmitted to the end supports through increased tension in the cable and compression in the blocks. The total load of the bridge, dead and live, is therefore transmitted through a combination of tensile and compressive forces to the end supports.

At the center of a level span, as shown in FIG. 3, the tension arch transmits the forces through a combination of tensile and compressive forces. Here both the tensile force of the cable and the compressive forces in the block are horizontal. These forces are unequal and in opposite directions.

It is an object of this invention to build a bridge which transmits its load to the end supports through a combination of inclined tensile forces and inclined compressive forces.

It is a further object of this invention to build an arch bridge which transmits its dead load to the end supports primarily through the cables.

It is a further object of this invention to build a bridge which transmits its live load through the composite action of the cable and the compressive element.

It is a further object of this invention to construct a bridge which transmits its load to the earth through compressive forces, wherein the dead load of the compression elements is primarily supported during construction by tension elements thus avoiding the necessity of erecting temporary scaffolding.

It is a further object to construct a bridge of discrete, not monolithic, elements so the bridge may be mass produced, assembled, disassembled and moved without destruction of its elements.

It is a further object of this invention to construct a bridge at a substantial cost savings by fabricating the majority of the bridge off site in similar relatively small units.

BRIEF DESCRIPTION OF THE DRAWINGS

The invention will be better understood and the objects other than those set forth above will become apparent when consideration is given to the following detailed description thereof. Such description makes reference to the annexed drawings wherein:

FIGS. 1A–G are schematic views of the various types of prior art bridges;

FIG. 2 is a force stress diagram of the end of the tension arch;

FIG. 3 is a force stress diagram of the center of the tension arch;

FIG. 4 is a side view of the tension arch bridge;

DETAILED DESCRIPTION OF THE PREFERRED EMBODIMENT

Figure 6:
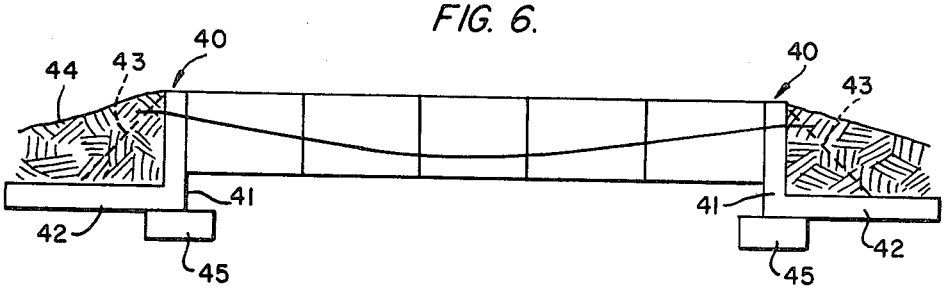
FIG. 6 is a side view of an alternate view of the tension arch.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications of the illustrated device, and such further applications of the principles of the invention as illustrated therein being contemplated as would normally occur to one skilled in the art to which the invention relates.

Figure 5:
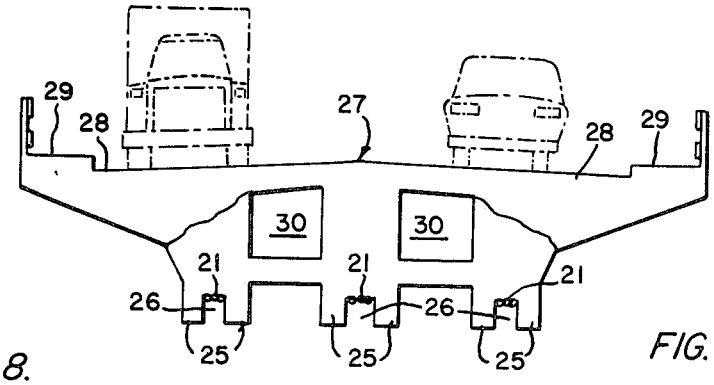
FIG. 5 is a cross-sectional view on lines 5—5 of FIG. 4.
Figure 8:
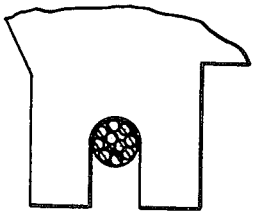
FIG. 8 is an alternative embodiment of the detail of FIG. 7.

The tension arch bridge shown in FIGS. 4 and 5 consists of three principal elements; end supports 20, cables 21 and prefabricated transverse blocks or roadway deck elements 22.

Each end support 20 must transmit the horizontal and vertical loads of the bridge to the earth. It will therefore be of a size and shape appropriate to that task. The ends of the cables 21 are anchored in each end support by means of suitable fittings.

The cables 21 span the distance between the end supports. and are spaced apart a distance as hereinafter described. The cables assume a predetermined catanary shape 24 with a sag (f) at the center. The cables may be any element with high tensile strength, low cost and low weight. They may, for instance, be wire cable, chain links, thin steel plates, plastic strands or carbon filaments.

The deck elements 22 are all similar. They may be precast concrete, steel, wood or plastic. They are prefabricated off site. In transverse profile they may have three pairs of depending flanges 25 forming three slots 26. The number and width of the slots are primarily dependant on the length and width of the bridge. The depth of the slots at the center of the bridge will be greater than the diameter of the cable. The width of the slot will be sufficient to fit over the cables. Above the slots is the upper surface 27 which may be divided into vehicular lanes 28 in the center and pedestrian lanes or sidewalks 29 at the edges. In the center of the deck element are central apertures 30 to reduce weight.

Figure 7:
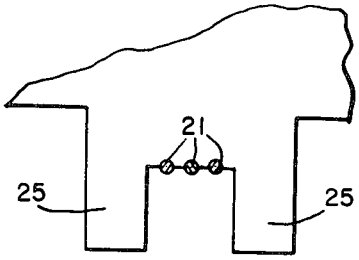
FIG. 7 is an enlarged view of a portion of FIG. 5.

Each depending slot 26 will be of a shape determined by its position along the cable. Near the center the slot will be shallow and flat. Near the end supports the slot will be deeper and sloped. The width of the slot will be dependant on the number and diameter of the cables. FIG. 7, an enlargement of the central set of flanges 25 of FIG. 5, shows a slot 26 for four cables 21, the slot having four generally semicircular concavities at its bottom to cooperate with the cables.

The slots for each deck element will be of similar shape and depth. The slots for different deck elements will be of different shape and depth. The slots for the deck elements adjacent each end support will differ in depth from the slots for the deck element at the center of the bridge by an amount equal to the sag (f) of the cables. Intermediate deck elements will have slots with a shape appropriate to their position along the cable between the end of the bridge and the center. The upper surface of each deck element will be at a predetermined height. The predetermined height will be selected based upon the use and location of the bridge pursuant to conventional highway design practice and does not form a part of this invention. The number of deck elements will be such as to exactly and fully occupy the space between the two end supports.

Between the deck element are keys 33 which are inserted to assist in transmitting shear forces from one deck element to the next. The keys may also include dowels or bolts. The position, size and shape of these keys may vary within wide ranges, as is well known.

By way of example only a bridge may have the following dimensions and component sizes:

Span between abutments: 50 feet
Number of cables: 10
Size of cables: $1\frac{1}{2}$ inch diameter
Type of cable: Bridge strand
Weight of each cable: 3.28 lb/ft.
Catanary sag: 2.0 feet
Width of deck element: 36 feet
  2 14-foot traffic lanes
  2 4-foot curb lanes
Width of each deck element: 5 feet
Height of each deck element: 2.5 feet
Weight of each deck element: 25,000 lbs.
Total weight of deck elements: 130 tons

Construction

The end supports are constructed in place with the appropriate fittings to receive the cables. The cables are then strung between the end supports and are stressed to the designed catanary sag and tension.

The individual deck elements are prefabricated. Each deck element is then lifted above and placed on the cables. The center deck element may be placed first on the cable adjacent an end support by a small crane able to lift one deck element and swing it onto the cable.

The deck element is then slid along the cables to the center position. If all of the deck elements are to be erected from one end support, then the first deck element erected will be that whose place is adjacent the far end support. It will be slid to the far end support. Each deck element will be erected in the sequence of their position. When the last deck element is put into place the bridge is complete.

There are a number of techniques for inserting the last block into the bridge. The block may be undersized and opposed wedges may fill the space. There may be an internal adjustability in the block such as with shims and lateral expansion by jacking. There may also be a grout pocket filled with expanding grout.

An important feature of this bridge is the economy of construction. No scaffolding is required and expensive on site fabrication is minimized. The total time required to build a bridge is greatly reduced. This leads to a secondary saving in replacing an existing bridge. A substantial cost factor at present is the cost of building temporary alternatives around a bridge during reconstruction. This bridge will allow the entire project to be done in a much shorter time. The greater disruption of simply closing the bridge is acceptable in view of the large cost savings.

Alternative Embodiments

As shown in FIG. 6, the tension arch structure may be constructed as a portable bridge having both military and civil applications.

The end supports 40 are prefabricated into an L shape with a vertical wall 41 and horizontal leg 42 of equal or greater length. These end supports will rest on pads 45. Suitable strengthening elements such as flanges 43 or cables connect the two. The top of the wall defines the height of the roadway.

The end supports are placed in position with the legs preferably pointed away from each other. Earth or rocks 44 are placed into the area defined by the L to prevent or retard rotation of the end support. This earth also serves as the foundation for the approach roadway to the bridge.

Cables 21 are strung between the end supports 40 near but below the top of the walls. The transverse blocks 22 are then raised and slid into position. When the last block is lowered into place the bridge is ready for operation, assuming the approaches have been completed.

As the bridge must support a heavy load, the end supports 40 may rotate slightly. This counter-stresses the structural system similar to a prestressed or post-tensioned beam, further contributing to its ability to carry the heavy load.

A particular feature of this embodiment is that the completed bridge does not rely upon the transmission of tensile forces to any of the surrounding earth surfaces. Indeed it does not rely upon the rock or earth 44 to prevent rotation of the end support.

As is apparent, this bridge may be assembled, disassembled and reassembled at a new location without destruction of any component. Unlike the steel beam or reinforced concrete bridge, the roadway surface is discrete blocks rather than monolithic structures suitable only for one time use.

Figure 12:
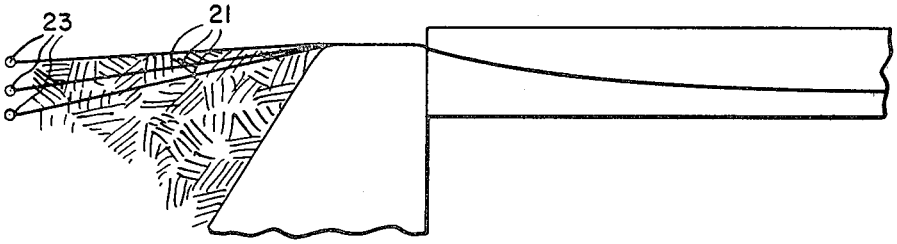
FIG. 12 is a detail of an alternative view of anchoring the cables.

As shown in FIG. 12, the tension arch structure may also be constructed with an end support 20 which carries no tensile forces at all as the cables 21 are passed over it and anchored to the earth beyond. Each cable may be anchored at a single spot or anchored at multiple spots 23. The end support will transmit the compressive forces when the blocks are installed and will transmit the vertical component of the tensile forces of the cable, due to its passing over the end support.

The tension arch may be constructed with a pier like end support in which the cable is passed over it and anchored to the earth beyond, during the further construction, as described above. When construction is completed the cable may then be rigidly attached to the end support relieving the tension on the cable anchors beyond the end support. These anchors may then be removed. Alternatively the cables may be initially anchored to the end support and auxillary cables may supply the added tension during construction, being removed after construction is completed.

The deck elements 22 may be constructed with identical slots 26 and therefore identical shape, if another element, a spacer, of differing shape, is added to the top of each slot. This construction is useful if the deck element is constructed of precast concrete, in which case all of the elements may be cast in a single form.

Figure 9A:
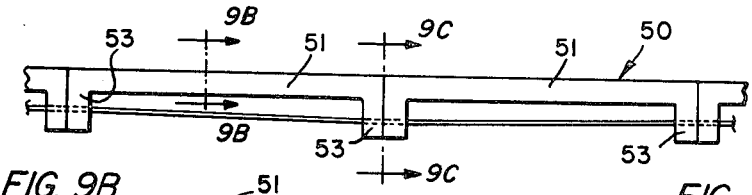
FIGS. 9A–C are side and sectional views of a second alternative view of the tension arch.
Figure 9B:
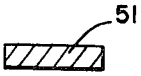
Figure 9C:
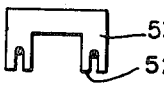

A reduced weight version of the bridge is shown in FIGS. 9A, B and C. The transverse blocks or deck elements 50 are all similar in shape. They vary in cross section however, in having a central portion 51 with no depending flanges, and end portions 53 with depending flanges 52.

Figure 10:
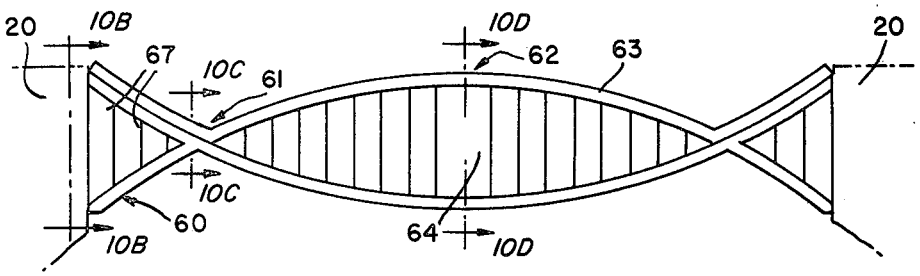
FIGS. 10A–D are side and sectional views, with an expanded vertical dimension, of a third alternative of the tension arch.

FIGS. 10A–D show a second reduced weight version of the tension arch. The transverse blocks 60, 61, and 62 vary in cross-section across the length of the bridge. The vertical distances in FIG. 10A are greatly expanded for clarity.

Figure 10B:
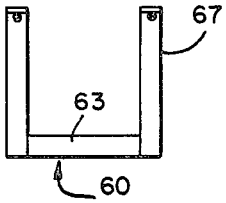
Figure 10C:
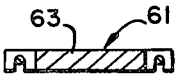
Figure 10D:
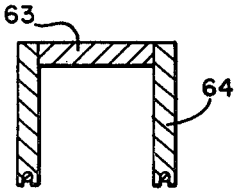

The roadway 63 is not at a uniform height but is in the shape of a flattened arch. As shown in FIGS. 10B–D the roadway forms the principal mass of each transverse block and carries the principal compressive load of the block.

At the center span, as shown in FIG. 10D, the roadway is at the maximum height above the cables. The depending flanges 64 need only carry the vertical forces which are an order of magnitude less than the horizontal compressive force of the roadway and horizontal tensile load of the cables.

At the intersection, as shown in FIG. 10C, the roadway and cables are at the same level. The cross-section of the structure is minimum at this position of the bridge.

At the end supports 20, as shown in FIG. 10B, the roadway is at a maximum distance below the cables. The roadway is suspended from the cable by hanger flanges 67, between the end supports 20 and the intersection at FIG. 10C.

Figure 11:
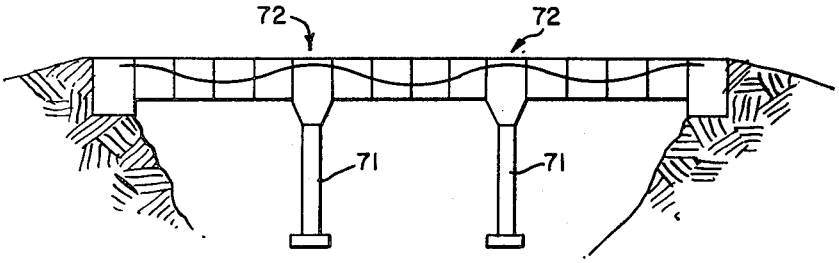
FIG. 11 is a multiple span version of the tension arch.

As shown in FIG. 11, a longer bridge may be built with intermediate supports or piers 71. The piers will have a top surface at the height of the roadway. Each pier will have grooves 72 cut in that surface so that the cables rest in them. For a level bridge they would be at the same height as the cables are anchored at the end supports. The cables will have a design catanary shape between each of the piers and between each of the piers and end support. If the piers are equidistant between the end supports, the catanaries will each be identical.

A principal United States market for bridge structures is the replacement market. The railway network is not expanding and the highway network is largely complete. The design life of current bridges is approximately fifty years. In some cases it is only the center spans that need replacement. The end supports and intermediate piers of existing bridges may be modified and may be used to support the cables while only the new deck elements need be added.

Figure 13:
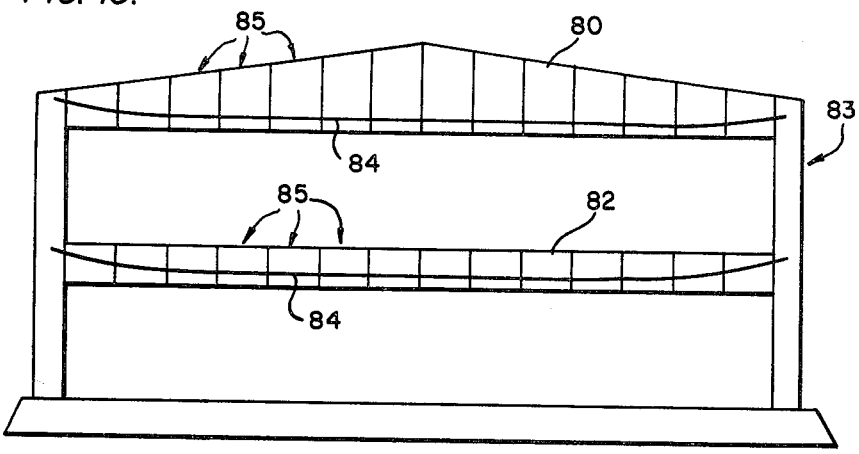
FIG. 13 is a side view of two tension arches and a second story and roof of a building.

FIG. 13 discloses the tension arch as a structure for a roof 80 and intermediate flooring 82 of a building 83. The roof and intermediate flooring each consists of parallel cables 84 and transverse blocks 85 which will vary in thickness for the roof. When the building is complete, the end walls will transmit a substantially vertical compressive force to the ground. In this embodiment the horizontal compressive and tensile forces will be substantially equal as well as opposite.

The tension arch structure of FIG. 13 may be used either for a rectangular building or for the circular domed roof of a stadium. In this embodiment the tension elements will radiate out from the center to the walls. The transverse blocks will be segments of a circle rather than rectangular in top sectional view. The blocks will be concentric washer shaped rings which fill the circular shape of the roof.

Figure 14:
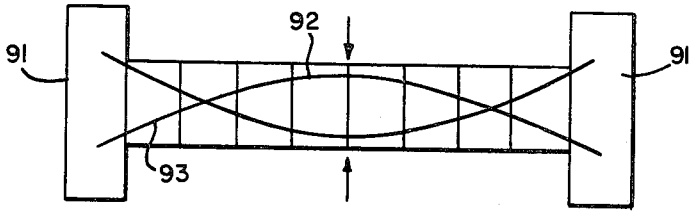
FIG. 14 is another version of the tension arch for resisting forces in two directions.

As shown in FIG. 14 the tension arch structure may be utilized to withstand lateral forces from two directions. The end supports 91 receive two sets of cables 92 and 93 which describe opposite catanary or parabolic curves.

As shown, the structure could resist either upward or downward forces. This version of the tension arch structure could also be vertical where the tension arch structure became a wall, reinforced by the cables against buckling, thus allowing taller, thinner, supporting columns or walls for buildings.

Figure 15:
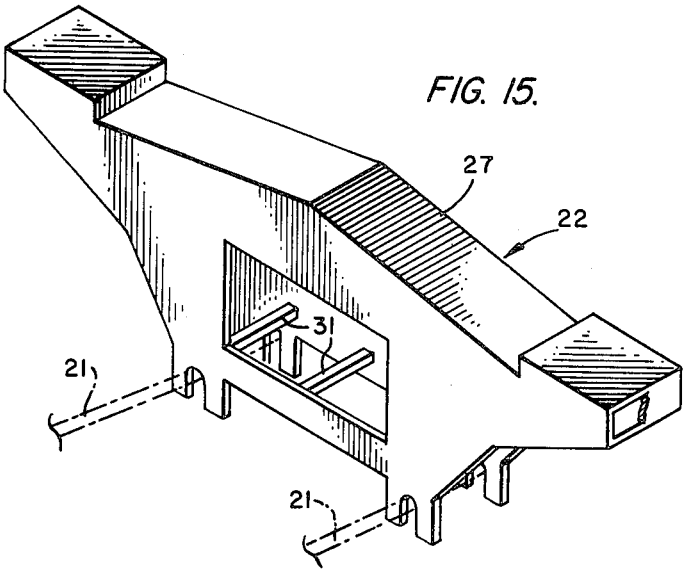
FIG. 15 is a perspective view of a tension arch fabricated of metal.

FIG. 15 shows in perspective a deck element 22 prefabricated from metal. It is designed for a single pair of cables 21. The upper surface 27 is solid metal and underneath are horizontal braces to hold the vertical faces apart and to help transmit the compressive forces.

Although the present invention has been described with reference to a few particular embodiments thereof, it should be understood that those skilled in the art may make many other modifications and embodiments thereof which will fall within the spirit and soope of the principles of this invention.

What is claimed as new and desired to be secured by Letters Patent of the United States is:

1. A load-bearing structure for supporting a vertical load over a span comprising in combination:

(a) opposing end supports;
(b) a plurality of tension elements;
(c) each tension element strung between and fastened to said end supports with a predetermined sag;
(d) a plurality of transverse compressive elements;
(e) each transverse compressive element having a depth greater than the sag of the tension element;
(f) each transverse compressive element supported by the tension elements;
(g) each transverse compressive element having an upper surface at the predetermined height above the level of the tension element;
(h) each transverse compressive element having a lower surface below the level of the tension element;
(i) each transverse compressive element fitted in abutting relationship with the adjoining transverse compressive element;
(j) the end transverse compressive elements fitted in horizontal abutting relationship with the end supports;
(k) the point of attachment of the tension element to the abutment being above the center of compressive force of the transverse compressive element at its interface with said abutment;
(l) means to resist shear between the adjoining transverse compressive elements;

whereby the load over the span is transmitted to the end supports in part through the compressive forces of the transverse compressive element and in part through the tensile force of the tension element.

2. The combination of claim 1 wherein the tension elements pass over a series of intermediate piers, each of said piers supporting the tension elements at a predetermined height.

3. The combination of claim 1 wherein the end supports have a vertical and a horizontal leg, (a) said end supports aligned with said vertical legs facing the center of the bridge and said horizontal legs extending from the bottom of the vertical leg in a direction away from the center of the bridge,
(b) the horizontal leg having earth above it to act as a counterweight resisting rotation due to the tensile force of the tension elements.

4. The combination of claim 1 wherein the transverse compressive elements are of non-uniform shape, having a compressive roadway portion which is lowest at the end supports and highest in the middle and vertical means connecting the compressive elements and the tensile elements to hold the tensile elements at spaced vertical position, below the roadway at the center, at the roadway at the intersection with tension element, and above the roadway at the end supports.

5. The combination of claim 1 wherein said tension element comprise independent smaller tension elements, each of which lies in parallel alignment underneath the structure and is independently anchored on each end support.

6. A bridge structure for crossing a chasm comprising in combination:

(a) a pair of end supports on either bank of the chasm;
(b) a plurality of tension elements strung in parallel alingnment between and fastened to said end supports, each tension element with a predetermined sag;
(c) a plurality of transverse compressive deck elements, each transverse compressive deck element having an upper load bearing surface and a plurality of pairs of depending flanges for each tension element forming a slot of a width sufficient to surround each tension element;
(d) each transverse compressive deck element having the upper surface above the tension element and the bottom of the flanges below the tension element;
(e) said pairs of depending flanges spaced apart a distance equal to the distance between said tension elements;
(f) each slot having a depth determined by the lateral position of the transverse compressive deck element on the bridge;
(g) the slot on the transverse compressive deck element adjacent the end support having a maximum depth and the slot on the transverse compressive deck element at the center of the bridge having a minimum depth equalling said maximum depth minus the sag in the tension element, and;

(h) said transverse compressive deck elements fitted in abutting relationship across the length of the bridge;

(i) the end transverse compressive elements fitted in horizontal abutting relationship with the end supports;

(j) the point of attachment of the tension element to the abutment being above the center of compressive force of the transverse compressive element at its interface with said abutment;

(k) keying means between said transverse compressive deck element to prevent movement between them;

whereby said deck elements have their load bearing upper surfaces at a predetermined height, the live load is supported both by the compressive force through the deck elements and by the tensile force in the tension element and the majority of the dead load is supported by the tensile forces of the tension elements, and the structure counterstresses itself when the load is applied.

7. The combination of claim 6 wherein each transverse compressive element has a central portion of reduced depth above the tension element and end portions of increased depth below the tension element defining said depending flanges.

* * * * *